United States Patent [19]

Wiles

[11] 3,984,109

[45] Oct. 5, 1976

[54] LIGHTED CHESS GAME

[75] Inventor: William Lloyd Wiles, Hagerstown, Md.

[73] Assignee: Lawrence Peska Associates, Inc., New York, N.Y. ; a part interest

[22] Filed: Aug. 20, 1975

[21] Appl. No.: 606,245

[52] U.S. Cl. ..... 273/136 A; 58/145 D; 58/153; 273/136 G; 273/136 D; 273/137 A

[51] Int. Cl.[2] ..... A63F 3/02

[58] Field of Search..... 273/136 A, 136 G, 137 A, 273/136 D; 58/145 D, 153

[56] References Cited

UNITED STATES PATENTS

| | | | |
|---|---|---|---|
| 2,257,687 | 9/1941 | Huffaker | 273/136 G |
| 3,654,392 | 4/1972 | Beinhocker | 273/136 A X |
| 3,683,363 | 8/1972 | Khiebutin | 273/136 A X |
| 3,698,180 | 10/1972 | Klein | 273/136 A X |
| 3,854,725 | 12/1974 | Cluck | 273/137 A X |

*Primary Examiner*—Anton O. Oechsle
*Attorney, Agent, or Firm*—Jack D. Slobod

[57] ABSTRACT

A chess game in which the chess pieces of both colors are translucent and carry a lamp; battery, miniature radio receiver and switch responsive to the receiver which couples the lamp for energization by the battery in response to receipt of a control signal. The receivers of differently colored chess pieces are responsive to control signals of different frequencies. A control unit including a timing motor driven commutator alternately turns on a pair of radio transmitters of different frequencies for a predetermined time duration for alternately lighting the pieces of each color to indicate the time in which a move must be made.

3 Claims, 6 Drawing Figures

LIGHTED CHESS GAME

FIELD OF THE INVENTION

The present invention relates generally to chess games having illuminated chess pieces and to chess clocks. In its particular aspects the present invention relates to apparatus for alternately lighting the chess pieces of each force to indicate a time period in which a move must be made.

BACKGROUND OF THE INVENTION

The game of chess is continually increasing in popularity and in particularly enjoyable when played at a rapid pace. Attempts have been made to provide a rapidly paced game by the provision of a chess clock for accounting for the total amount of time used by each player during a predetermined number of moves. I am of the opinion that the game would be more enjoyable if each player would have to make each move within a predetermined time period such as 30 seconds. Further, there is a need for indicating the running of the 30 second time period in a dramatic fashion such as with illuminated chess pieces.

The provision of illuminated chess pieces has been suggested in U.S. Pat. Nos. 3,579,856 and 3,854,725. However therein, the chess pieces are not illuminated to indicate a time period in which the pieces must be moved.

In connection with the board for the chess game it is known to provide a case for the chess pieces composed of pair of hingedly connected sections which are opened in coplanar relationship to form the chess board. One problem with such boards is that the board with pieces thereon is unstable and is moved only with great difficulty because the two sections are not locked together.

OBJECTS OF THE INVENTION

It is an object of the present invention to provide a chess game having pieces of two different colors which are alternately illuminated to indicate the time in which the pieces of each color must move.

It is a further object of the present invention to provide a chess piece case of the type which opens into a chess board, which will lock in an open position.

SUMMARY OF THE INVENTION

Briefly, the aforementioned and other objects of the present invention are satisfied by providing a chess game in which hollow translucent chess pieces of two colors carry lamps within their interiors. The chess pieces of each different color also carry receiver means respectively responsive to different control signals and also carry means for energizing the lamp in response to receipt of the control signals in a manner that the chess pieces of either color may be selectively illuminated.

A control unit includes a timer means for alternately turning on transmitters for the different control signals for a predetermined period of time such as 30 seconds for indicating the time period in when a move must be made and which color is to move. A short gap in time between one transmitter being turned off and the other being turned on is also provided by the timer means.

In regard to the game board, I provide a case of two hingedly connected board sections. For locking the two sections in coplanar relationship, I provide a bolt means slideable through a pair of aligned guides on the two sections.

Rather than providing electrical contacts on the game board for transmission and reception of the control signals, I provide the transmitters and receivers to operate at radio frequencies so that a piece held off the board such as in the process of a move will also be active for signalling that time has expired.

Other objects, features and advantages of the present invention will become apparent upon perusal of the following detailed description of the preferred embodiment thereof when taken in conjunction with the appended drawing wherein.

DETAILED DESCRIPTION

Figure 1:
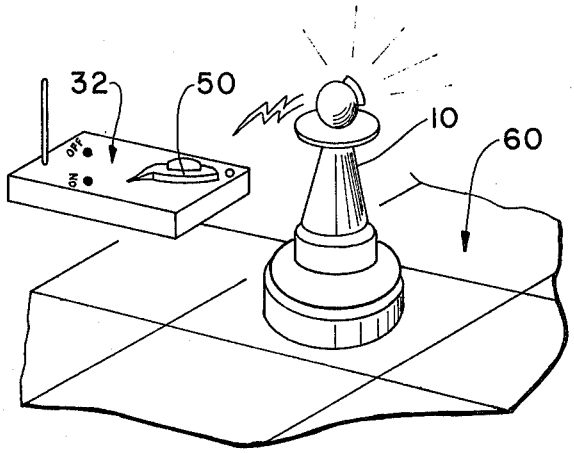
FIG. 1 is a pictorial presentation of a portion of the chess game of the present invention in conjunction with a control unit.

Referring to FIGS. 1 and 3–5 of the drawing, the chess game of the present invention includes hollow translucent plastic chess pieces 10 of two different colors. I prefer that the chess pieces of one force be red and of the other force be blue to connotate various changes of the rules of the game associated with black and white chess pieces. For example, in contradistinction to the usual rule where white always moves first, I propose, for example, that a set of two games constitute a match with the red pieces making the first move in one game and the blue in the other.

Each of the chess pieces 10 carries a lamp 12 within its upper end and an elongated battery 14 in a vertical orientation.

Figure 4:
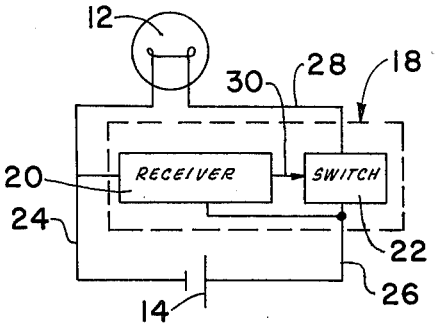
FIG. 4 is a schematic of the circuiting within the chess piece of FIG. 3.
Figure 5:
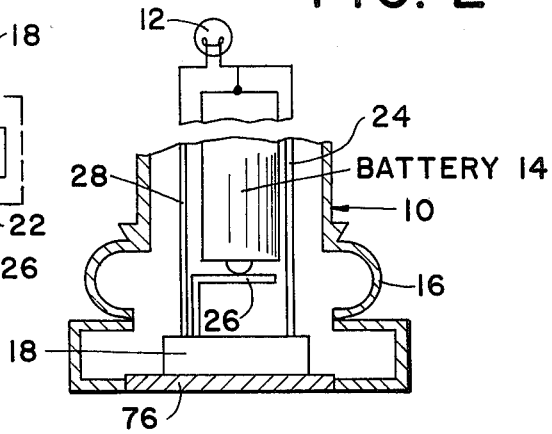
FIG. 5 is an enlarged elevational cross-sectional view of the base of the chess piece in FIG. 3 including a schematic representation of the upper part of the chesspiece.

Further, within the base portion 16 of each piece there is located a unit 18, which as shown in FIGS. 4 and 5 comprises a radio receiver 20 and electrically controlled normally open switch 22. Unit 18 is connected to opposite sides of battery 14 by metallic strip conductors 24 and 26 which form a holder for the battery. Lamp 16 has one terminal connected to strip 24 and another terminal connected to strip 28 which runs within the piece 10 to unit 18. Radio receiver 20 is powered from strips 24 and 26 and has an output 30 which feeds the control input of the switch 22 for activating the switch to provide electrical continuity between strips 26 and 28 in response to receipt of a control signal. Thus, as should be apparent, lamp 12 is energized by battery 14 when switch 22 is actuated in response to receiver 20.

The radio receivers 20 of the chess pieces of the two different colors are respectively tuned to be responsive to two different radio frequencies to provide the capability for selectively illuminating either the red pieces or the blue pieces.

Figure 2:
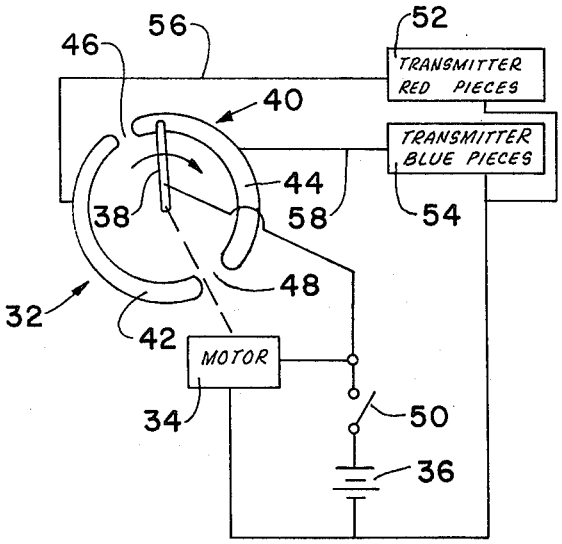
FIG. 2 is a schematic for the control unit.
Figure 3:
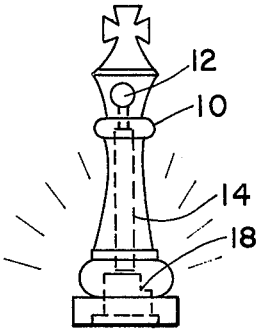
FIG. 3 is an elevational view of a chess piece including electrical circuitry therein

As illustrated in FIGS. 1 and 2, a portable control unit 32 is provided for remotely controlling the illumination of the chess pieces 10. Control unit 32 comprises a d.c. motor 34 which runs at a constant speed in response to energization by a battery 36 within unit 32. Motor 34 drives a rotating wiper arm 38 of a commutator 40 which cooperates with a pair of opposed stationary arcuate electrodes 42 and 44 configured to be contacted by wiper 38 during a portion of its rotation cycle. Preferably the motor 34 is configured so the wiper 38 will make a complete revolution in about 70 seconds and the electrodes 42 and 44 extend angularly to be contracted for different 30 second time periods. Further, opposed angular gaps 46 and 48 between the electrodes 42 and 44 each extend angularly corresponding to a time period of about 5 seconds to provide relatively short time gaps where neither of the electrodes is contacted.

Both motor 34 and wiper 38 are electrically connected to battery 36 via an on-off switch 50 carried on unit 32. Two different radio transmitters 52 and 54 are provided in unit 32 each having a different output frequency. Transmitter 52 has an output frequency corresponding to the receiver 20 of the red pieces and transmitter 5 and has an output frequency corresponding to the receiver 20 of the blue pieces. As should further be apparent from FIG. 2, transmitters 52 and 54 are respectively powered from electrodes 42 and 44 by connections thereto via levels 56 and 58. Thus transmitters 52 and 59 are alternately turned on for thirty second time periods for alternately illuminating the lamps 12 of the red pieces and the blue pieces to indicate the time period in which a move must be made and the color whose turn it is to move.

The lighting of the chess pieces in the aforementioned manner provides a quite dramatic effect. For example, the provision of radio remote control enables a chess piece which is held off the game board, as during the course of the move to indicate whether time is remaining for the move. The time gaps between illumination of the chess pieces of the different colors, due to the angular gaps 46 and 48 provide a short rest period between moves which is beneficial to keeping up a rhythmical pace in playing the game.

Figure 6:
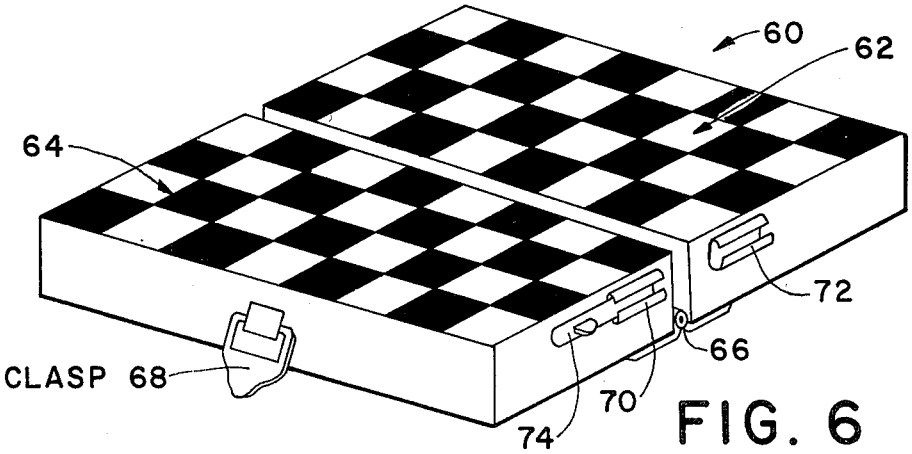
FIG. 6 is a pictorial presentation of a chess board for the game of the present invention.

As shown best in FIG. 6, I provide a game board 60 which is of the type which forms a case for holding the pieces 10. Board 60 is composed of a pair of case halves or sections 62 and 64 hinged together at 66. The two sections may be closed and secured together with clasp means such as 68 for storing pieces 10 or the sections may be opened to lie in coplanar relationship in order to form the board 60. For locking the two sections in coplanar relationship, I provide a pair of aligned guides 70 and 72 carried by the respective sections. A bolt 74, captured in guide 70, is slideable for insertion in guide 72 to stabilize the sections 62 and 64 from swinging about hinge 66.

As an additional stabilization feature, the playing surface of board 60 may be ferromagnetic and axially magnetized disc magnets 76 may form the bottom of pieces 10 for holding the pieces on the board.

While the preferred embodiment of the present invention has been described in specific detail, it should be understood that numerous modifications, additions and omissions in the details thereof are possible within the intended spirit and scope of the invention claimed herein.

What is claimed is:

1. A chess game apparatus comprising: translucent chess pieces of first and second different colors; a lamp carried within each of said chess pieces; a control unit having a timer means for producing first and second signals alternating in time, each of said signals being of a predetermined time duration; means responsive to said timer means for transmitting said first and second signals; first and second receiver means respectively carried on chess pieces of said first and second colors which are configured for respectively receiving said first and second signals; and means carried by each of said chess pieces for energizing said lamp of said chess piece in response to signal reception by said receiver means.

2. The apparatus of claim 1 wherein said timer means is configured to have a time gap of a predetermined duration between said first and second signals.

3. The apparatus of claim 1 further comprising a game board formed of a pair of hingedly connected board sections and bolt means carried on said sections for locking said two sections in coplanar relationship.

* * * * *